US008141532B2

(12) United States Patent
Kameda

(10) Patent No.: US 8,141,532 B2
(45) Date of Patent: Mar. 27, 2012

(54) SPARK PLUG

(75) Inventor: Hiroyuki Kameda, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 291 days.

(21) Appl. No.: 12/312,521

(22) PCT Filed: Feb. 28, 2008

(86) PCT No.: PCT/JP2008/053482
§ 371 (c)(1),
(2), (4) Date: May 14, 2009

(87) PCT Pub. No.: WO2008/114592
PCT Pub. Date: Sep. 25, 2008

(65) Prior Publication Data

US 2010/0043748 A1 Feb. 25, 2010

(30) Foreign Application Priority Data

Mar. 22, 2007 (JP) ..... 2007-074448

(51) Int. Cl.
*H01T 13/40* (2006.01)
*H01T 13/46* (2006.01)

(52) U.S. Cl. ..... 123/169 R; 123/305

(58) Field of Classification Search ..... 123/169 R, 123/305, 298, 309, 301, 169 EA, 169 MG; 313/144, 143, 141, 118
See application file for complete search history.

(56) References Cited

U.S. PATENT DOCUMENTS 2,483,288 A * 9/1949 Malin ..... 123/298
4,318,377 A * 3/1982 Occella et al. ..... 123/279
4,514,657 A * 4/1985 Igashira et al. ..... 313/130
5,189,333 A * 2/1993 Kagawa et al. ..... 313/140
5,477,104 A * 12/1995 Tanabe et al. ..... 313/137

FOREIGN PATENT DOCUMENTS

| | | |
|---|---|---|
| JP | 49-36344 | 3/1974 |
| JP | 63-112789 | 7/1988 |
| JP | 2-1474 | 1/1990 |
| JP | 4-4583 | 1/1992 |
| JP | 3607526 | 10/2004 |
| JP | 2005-50612 | 2/2005 |
| JP | 2006-228522 | 8/2006 |
| WO | WO 2007/010867 | 1/2007 |

OTHER PUBLICATIONS

Int'l Search Report of PCT/JP2008/053482 (in English), dated May 27, 2008; 2 pages.
Notification of Reason for Refusal from corresponding Japanese Patent App. No. 2009-505114 (with English translation), dated Aug. 23, 2011; 8 pages.

* cited by examiner

*Primary Examiner* — Mahmoud Gimie
(74) *Attorney, Agent, or Firm* — Kusner & Jaffe

(57) ABSTRACT

A peripheral wall extending portion is formed in such a manner that a front end side of a cylindrical hole of a metal shell projects forward in an axis O direction, and the peripheral wall extending portion comprising: a projecting portion formed into a projecting shape, and a connecting portion which connects between the projecting portions. A fuel injected from an injection orifice of an injector strikes against the projecting portion and is unlikely to directly reach to a spark discharge gap formed between a noble metal tip and a front end portion of a ground electrode. The fuel that strikes against the projecting portions without striking against the projecting portion is separated into a droplet-like incompletely vaporized fuel that adheres to the projecting portions and a vaporized fuel being reflected to a perimeter of the spark discharge gap.

7 Claims, 7 Drawing Sheets

SPARK PLUG

FIELD OF THE INVENTION

The present invention relates to a spark plug to be mounted on an internal-combustion engine so as to ignite an air-fuel mixture.

BACKGROUND OF THE INVENTION

Conventionally, a spark plug for ignition is used for an internal-combustion engine. A conventional spark plug is comprised of: a center electrode having an electrode for spark discharge on a front end side thereof; an insulator accommodating the center electrode in its axial bore; and a metal shell surrounding and holding the insulator in a radial direction thereof. An end portion of a ground electrode is joined to the metal shell, and a spark discharge gap is formed by the other end portion of the ground electrode and a front end portion of the center electrode. A spark is discharged in the spark discharge gap to thereby ignite an air-fuel mixture.

In a direct injection engine, an injection orifice of an injector for injecting a fuel is exposed to the combustion chamber. When the above spark plug is mounted on the direct injection engine, and when a fuel directly strikes the spark plug, short-circuit may occur in the spark discharge gap due to a droplet of fuel, which causes a so-called fuel bridge. As a result, there is a possibility to cause a misfire. In order to avoid such a phenomenon, the injection orifice is disposed so that the fuel is injected towards an inner wall or a piston of the combustion chamber. Furthermore, by using a compressed air when the piston moves upward, an injection pressure, an amount of injection and an injection timing of the injector or the like are controlled so that a rich fuel layer reaches to a perimeter of the spark discharge gap at the time of ignition. In this way, when the injected fuel strikes against the inner wall or the piston of the combustion chamber, a droplet of incompletely vaporized fuel (i.e., any fuel not vaporized when the injected fuel is atomized and mixed with air to form the air-fuel mixture) adheres thereto, and a vaporized fuel (a splay-like injected vaporized fuel contained in the air-fuel mixture) is separated. Thus, the vaporized fuel reaches to the spark discharge gap, and prevents the fuel bridge. Further, a configuration in which the ground electrode is surrounded by a wall surface (protective member) may be employed (e.g., refer to Patent Document 1) so that the droplet-like incompletely vaporized fuel is unlikely to enter in the spark discharge gap, even though it reaches to the spark discharge gap. Patent Document 1 Japanese Patent Application Laid-Open (kokai) No. 2006-228522.

SUMMARY OF THE INVENTION

However, in a conventional spark plug, since injecting conditions of fuel vary according to engine drive conditions, it becomes complicate to control an injection pressure, an amount of injection and an injection timing of an injector or the like when a control feature is added to modify the fuel flow so as not to directly strike the spark plug. Moreover, since an inner wall of a combustion chamber has a relatively low temperature in the combustion chamber, when injecting fuel towards the inner wall, the fuel adhering to the inner wall cannot be completely combusted and is likely to remain as soot. On the other hand, although the conventional art disclosed in Patent Document 1 can prevent formation of fuel bridge in the spark discharge gap, it is difficult for a vaporized fuel to reach to the spark discharge gap because the perimeter of the spark discharge gap is surrounded by a wall surface. As a result, the air-fuel mixture is unlikely to be ignited by the spark discharge. Furthermore, since a front end portion of an insulator is also surrounded by the wall surface, heat is likely to accumulate and the temperature of a spark plug may exceed its allowable limit.

The present invention has been accomplished in order to solve the above-mentioned problems. An object of the present invention is to provide a spark plug capable of controlling a fuel injected from an injector such that the fuel does not directly reach a spark discharge gap, yet is capable of readily igniting an air-fuel mixture with a spark discharge.

According to a first aspect of the present invention, there is provided a spark plug comprising: a center electrode and an insulator having an axial bore that extends in an axial direction, and the axial bore holding the center electrode at a front end side of the axial bore.

A metal shell has a cylindrical hole that extends in the axial direction. The cylindrical hole accommodates the insulator therein. The metal shell includes a peripheral wall extending portion at a front end side thereof which is formed so as to radially surround a perimeter of the front end portion of the insulator, when the metal shell is mounted on an engine head of a combustion engine. The peripheral wall extending portion has a projecting portion that extends in the axis direction along with the front end of the insulator towards the combustion chamber side with respect to the inner wall surface of the combustion chamber. A ground electrode is provided having one end joined to the peripheral wall extending portion and the other end forming a spark discharge gap with a front end side of the center electrode. The peripheral wall extending portion is comprised of a plurality of projecting portions intermittently formed in the metal shell in a circumference direction thereof. The peripheral wall extending portion extends in the axial direction towards the combustion chamber side with respect to the inner wall surface. A connecting portion connects the plurality of projecting portions in the circumference direction of the metal shell and is positioned so that a projecting front end of the connecting portion is disposed relatively rearward with respect to the projecting portions. At least one of the projecting portions has a projecting front end joined to the one end of the ground electrode.

According to the first aspect of the present invention, because the peripheral wall extending portion has the plurality of projecting portions, when a spark plug is mounted on an engine head, the projecting portion intercepts the injected fuel and reduces the amount of fuel reaching to the perimeter of the spark discharge gap. As a result, it is possible to prevent a so-called "fuel bridge" where the fuel causes short-circuit in the spark discharge gap. Further, when the injected fuel strikes against a projecting portion, some droplet-like incompletely vaporized fuel adheres to the projecting portion, and vaporized fuel and the incompletely vaporized fuel are separated. Since the plurality of projecting portions is disposed around the spark discharge gap, the vaporized fuel can flow around the spark discharge gap, thereby easily igniting the air-fuel mixture with a spark discharge.

Further, the peripheral wall extending portion has the connecting portion that connects between the projecting portions. When considering the rigidity of the peripheral wall extending portion, the front end of the peripheral wall extending portion is preferably disposed so as to project forward towards the front end side of the spark plug—i.e., project towards the combustion chamber side with respect to the inner wall face of the combustion chamber. On the other hand, as a projecting length of the connecting portion lessen, the air-fuel mixture including a fuel tends to enter to the inner circumference side of the metal shell through the connecting portion whereby the air-fuel mixture contacts with the insulator, resulting in taking the heat from the insulator. Therefore, by adjusting a projecting length of the connecting portion, the temperature of the insulator will not exceed an upper temperature limit of the spark plug. Thus, it is not necessary that the projecting front end of the connecting portion be disposed in a position that projects towards the combustion chamber side with respect to the inner wall face of the combustion chamber.

According to a second aspect of the present invention, there is provided a spark plug wherein a center of a line segment bounded by a center of a front end portion of the center electrode and an intersection, which is formed by a straight line passing through the center of the center electrode and parallel to an axis of the center electrode of the spark plug according to the first aspect and the ground electrode, is regarded as a center of the spark discharge gap, wherein a direction of the spark plug is adjusted when the spark plug is mounted on the engine head, wherein, in the projecting portions of the peripheral wall extending portion, a first projecting portion to which the ground electrode is joined is located in a position where a first virtual straight line connecting an opening center of the injection orifice and the center of the spark discharge gap is interrupted when the injection orifice of the fuel, the peripheral wall extending portion and the spark discharge gap, those of which are exposed to the combustion chamber, are projected on a first virtual plane perpendicular to the axis direction, and wherein, when a direction that connects both ends of the first projecting portion in a peripheral direction of the metal shell is regarded as a width direction, a length of the first projecting portion in the width direction is longer than a length between ends of the ground electrode in the width direction.

In this way, the first projecting portion intercepts the fuel injected from the injection orifice heading straight to the spark discharge gap. Thus, a droplet-like incompletely vaporized fuel, which is heavier than a vaporized fuel, is unlikely to directly reach to the spark discharge gap. On the other hand, since the vaporized fuel separated from the fuel that strikes against other projecting portions is likely to reach in the perimeter of the spark discharge gap, the air-fuel mixture can be easily ignited by spark discharge. Further, since the ground electrode tends to take heat from a flame kernel after igniting, the ground electrode is formed so as to have a relatively small volume. Since the first projecting portion is formed to be larger than the ground electrode in the width direction, it assuredly intercepts the fuel injected from the injection orifice towards the spark discharge gap.

According to a third aspect of the present invention, there is provided a spark plug wherein, in a state where the spark plug according to the second aspect is mounted on the engine head, a projecting front end of the first projecting portion is preferably located forward with respect to the first virtual straight line when the injection orifice, the first projecting portion and the spark discharge gap are projected on a second virtual plane including the opening center of the injection orifice and the axis of the metal shell.

In this way, since the projecting front end of the first projecting portion is located in the forward position (inside of the combustion chamber) with respect to the first virtual straight line, the fuel injected from the injection orifice and heading straight to the spark discharge gap is certainly intercepted. On the other hand, since the vaporized fuel separated from the fuel striking against other projecting portions is likely to reach at the perimeter of the spark discharge gap, the air-fuel mixture can be ignited easily by the spark discharge. Moreover, since it is possible to establish the structure where the spark discharge gap is disposed close to the injection orifice, the degree of freedom for an engine design can be large, thereby facilitating a miniaturization of the combustion engine.

In accordance with a fourth aspect of the present invention, there is provided a spark plug wherein a projecting front end of a second projecting portion is preferably disposed in a region bounded by an outline of a spread-angle of the fuel injected from the injection orifice when the second projecting portion, which is different from the first projecting portion in the projecting portions of the peripheral wall extending portion, and the outline of the spread-angle of the fuel injected from the injection orifice are projected on the second virtual plane of the spark plug according to the third aspect.

In this way, since the projecting front end of the second projecting portion is disposed in the region bounded by the outline of the spread-angle of the fuel injected from the injection orifice, the fuel can strike against the second projecting portion. Thus, since the droplet-like incompletely vaporized fuel in the fuel adheres to the second projecting portion and assuredly separated from the vaporized fuel, a greater amount of vaporized fuel is likely to flow in the perimeter of the spark discharge gap. Furthermore, a flow velocity of the vaporized fuel slows down as the fuel strikes against the second projecting portion whereby the vaporized fuel is likely to flow around the spark discharge gap. As a result, the air-fuel mixture is likely to be ignited by the spark discharge.

In accordance with a fifth aspect of the present invention, there is provided a spark plug wherein, on the first virtual plane of the spark plug according to the fourth aspect, at a center of an inner face facing to the spark discharge gap in an outer surface of the second projecting portion, a direction which intersects perpendicularly with the inner face is within an acute-angle defined by a direction from the center of the inner surface to the opening center of the injection orifice and a direction from the center of the inner surface to the center of the spark discharge gap.

Thus, when the direction to which the inner face of the second projecting portion faces is specified, a reflecting direction where the separated vaporized fuel striking against the inner face can be adjusted so as to head to the perimeter of the spark discharge gap. Thus, the vaporized fuel can assuredly flow around the spark discharge gap, thereby easily igniting the air-fuel mixture by spark discharge.

In accordance with a sixth aspect of the present invention, there is provided a spark plug wherein, on the second virtual plane of the spark plug according to the fifth aspect, the inner face of the second projecting portion is preferably formed into a face inclining to the axis and extending forward in the axis direction when the center of the spark discharge gap is disposed forward in the axis direction with respect to a second virtual straight line that intersects perpendicularly with the axis through the opening center of the injection orifice.

In this way, when the inner face of the second projecting portion is formed into the face inclining to the axis and extending forward in the axis direction, the reflecting direction of the fuel can also be adjusted in the axis direction. Thus, the vaporized fuel can assuredly flow around the spark discharge gap. As a result, when the center of the spark discharge gap is disposed forward in the axis direction with respect to the opening center of the injection orifice, the air-fuel mixture can be readily ignited by the spark discharge.

In accordance with a seventh aspect of the present invention, there is provided a spark plug wherein, on the second virtual plane of the spark plug according to the fifth aspect, the inner face of the second projecting portion is preferably formed into a face inclining away from the axis and extending forward in the axis direction when the center of the spark discharge gap is disposed rearward in the axis direction with respect to the second virtual straight line that intersects perpendicularly with the axis through the opening center of the injection orifice.

Thus, when the inner face of the second projecting portion is formed into the face inclining away from the axis and extending forward in the axis direction, the reflecting direction of the fuel can also be adjusted in the axis direction. Therefore, the vaporized fuel can assuredly flow around the spark discharge gap. As a result, when the center of the spark discharge gap is disposed rearward in the axis direction with respect to the opening center of the injection orifice, the air-fuel mixture can be readily ignited by the spark discharge.

DETAILED DESCRIPTION OF PREFERRED EMBODIMENT

Figure 1:
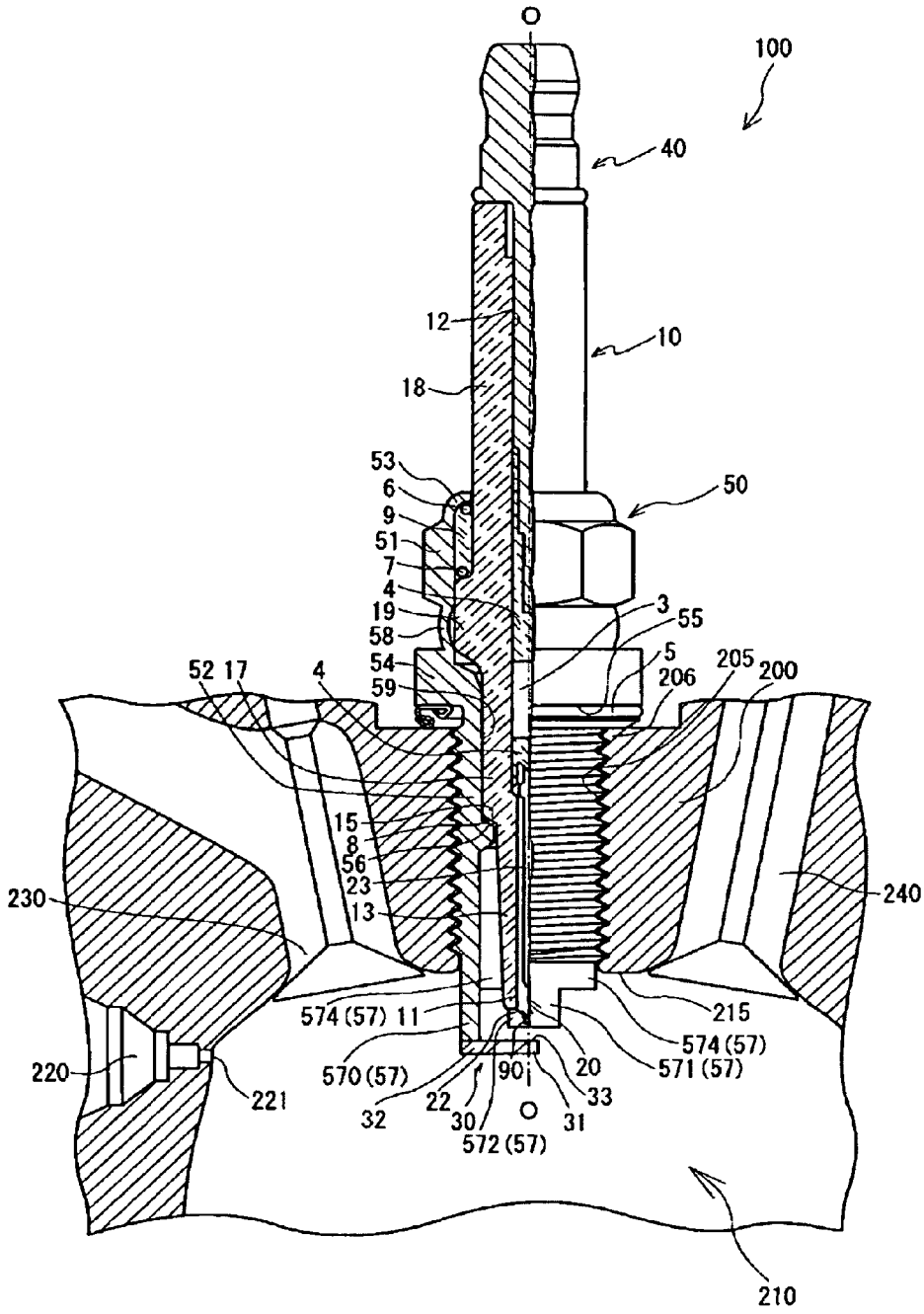
FIG. 1 is a partial sectional view of a spark plug 100 mounted on an engine head 200 of a combustion engine.

A first embodiment of a spark plug carrying out the present invention shall now be described with reference to the drawings. First, with reference to FIG. 1, an entire configuration of a typical spark plug 100 will be explained. In FIG. 1, the axis O direction of the spark plug 100 is referred to as the vertical direction, and the lower side is referred to as a front end side (front) of the spark plug 100, and the upper side is referred to as a rear end side (rear) thereof.

As shown in FIG. 1, the spark plug 100 of this embodiment is mounted on an engine head 200, of a so-called direct injection engine which directly injects fuel into a combustion chamber 210. In the combustion chamber 210, the fuel is injected from an injection orifice 221 of an injector 220. The fuel is mixed with air introduced into the combustion chamber 210 from an air inlet 230, and flows towards an exhaust port 240. The spark plug 100 is mounted on a mounting hole 205. The mounting hole 205 of the engine head 200 is positioned relative to the injection orifice 221 of the injector 220 so that a spark discharge gap (later described) is in a fuel flowing path. The configuration of the spark plug 100 shall now be described.

As shown in FIG. 1, the spark plug 100 is generally comprised of: an insulator 10, a metal shell 50, a center electrode 20, a ground electrode 30 and a metal terminal fitting 40. The metal shell 50 holds the insulator 10. The center electrode 20 extends in a direction along the axis "O" and is accommodated in an axial bore 12 of the insulator 10. One end (base end portion 32) of the ground electrode 30 is welded to the front end side of the metal shell 50, and the other end (front end portion 31) of the ground electrode 30 is disposed so that an inner face 33 of the other end forms a spark discharge gap with a noble metal tip 90, which is disposed on a front end of the center electrode 20. The metal terminal fitting 40 is formed in a rear end portion of the insulator 10.

Insulator 10 that serves as an insulator of the spark plug 100, will now be described. The cylindrical insulator 10 includes therein the axial bore 12 extending in the axis "O" direction. Insulator 10 is made of sintering alumina or the like as is commonly known. A flange portion 19, having the largest outer diameter, is formed at the rear end side with respect to a central area in the axis "O" direction. A rear end side body portion 18 is formed on the rear end side (upper side in FIG. 1) with respect to the flange portion 19. A front end side body portion 17 having a smaller outer diameter than that of the rear end side body portion 18 is formed on the front end side (lower side in FIG. 1) with respect to the flange portion 19. An elongated leg portion 13 having a smaller outer diameter than that of the front end side body portion 17 is formed at the front end side with respect to the front end side body portion 17. The diameter of the elongated leg portion 13 tapers gradually toward the front end side. The elongated leg portion 13 is exposed to a combustion chamber 210 when the spark plug 100 is mounted on the engine head 200.

The center electrode 20 will now be described. The center electrode 20 is made of nickel-system alloy or the like, such as INCONEL (trade name) 600 or 601, in which a metal core 23 made of copper or the like and having excellent thermal conductivity is provided. The center electrode 20 is accommodated in the axial bore 12 of the insulator 10 at the front end side of the insulator 10 so that an axis of the center electrode aligns with the axis "O" of the spark plug 100. A front end portion 22 of the center electrode 20 projects from a front end portion 11 of the insulator 10 and is tapered off towards the front end side (see FIG. 2). The noble metal tip 90 is joined to a front end of the projecting portion so as to improve resistance to spark erosion.

Further, the center electrode 20 is electrically connected to the metal terminal fitting 40 at the rear end side through a conductive seal material 4 and a ceramic resistance 3 both of which are provided inside the axial bore 12. A high voltage cable (not shown) is connected to the metal terminal fitting 40 through a plug cap (not shown) in order to apply high voltage.

Next, the metal shell 50 will be described. The metal shell 50 is a cylindrical metal fitting for fixing the spark plug 100 to the engine head 200 of the internal-combustion engine. The metal shell 50 has a cylindrical hole 59 which accommodates the insulator 10 therein so as to surround a region from the elongated leg portion 13 to a front end side of the rear end side body portion 18 of the insulator 10. The metal shell 50 is made of a low carbon steel material and has a large diameter fitting portion 52 formed in a region from a generally center to the front end side of the metal shell. On an outer circumference face of the fitting portion 52, a male-thread-shaped thread ridge is formed for engaging with a female thread provided on a mounting hole 205 of the engine head 200 whereby the spark plug 100 is fixed in the mounting hole 205. In addition, the metal shell 50 may be made of stainless steel or INCONEL and the like, placing great importance on heat resistance.

A flange-like sealing portion 54 is formed at the rear end side of the fitting portion 52. A gasket 5 is provided between the sealing portion 54 and the fitting portion 52. Gasket 5 is made from a sheet material and formed into an annular shape that is folded back on itself. The gasket 5 provides a sealing for an air leakage from the combustion chamber 210 through the mounting hole 205. More particularly, the gasket 5 is sandwiched and deformed between a seating face 55 of the sealing portion 54 which faces the front end side and an opening edge portion 206 of the mounting hole 205 of the engine head 200 to provide a seal therebetween.

Further, a tool engagement portion 51 for engaging with a spark plug wrench (not illustrated) is formed at the rear end side of the sealing portion 54. A thin caulking portion 53 is formed on the rear end side with respect to the tool engagement portion 51. A thin buckling portion 58 is formed between the sealing portion 54 and the tool engagement portion 51. Annular ring members 6, 7 lie between an inner circumferential face of the cylindrical hole 59 where the tool engagement portion 51 and the caulking portion 53 are formed and an outer circumferential face of the rear end side body portion 18 of the insulator 10. Furthermore, talc powder 9 is filled between the both ring members 6, 7. On the inner circumference face of the cylindrical hole 59, a step portion 56 projecting inwardly is formed in a continuous manner along the circumference direction. When the insulator 10 is accommodated in the cylindrical hole 59, a step portion 15 of the insulator 10 formed between the elongated leg portion 13 and the front end side body portion 17 of the insulator 10 is supported by the step portion 56 through an annular packing 8. Then, the edge portion of the caulking portion 53 is caulked and inwardly bent so that the insulator 10 is compressed towards the front end side in the cylindrical hole 59 through the ring members 6, 7 and the talc 9. At this time, the buckling portion 58 is heated so as to outwardly deform under an application of compressive force in a caulking process. As a result, the caulking portion 53 can provide some room for compression stroke. In this way, the insulator 10 is securely held between the caulking portion 53 and the step portion 56 in the cylindrical hole 59 whereby the metal shell 50 and the insulator 10 is integrated. The packing 8 secures the airtightness between the metal shell 50 and the insulator 10, thereby preventing combustion gas from flowing out through the cylindrical hole 59.

Moreover, on the front end side with respect to the fitting portion 52, a peripheral wall extending portion 57 having a smaller diameter than that of the fitting portion 52 is formed so as to extend forward in the axis o direction. The peripheral wall extending portion 57 projects forward in the axis O direction. When the spark plug 100 is mounted on the mounting hole 205 of the engine head 200, the peripheral wall extending portion 57 has a portion projecting towards an inner side of the combustion chamber 210 with respect to the inner wall face 215 of the combustion chamber 210. That is, when the spark plug 100 is mounted on the mounting hole 205 of the engine head 200, the front portion of the peripheral wall extending portion 57 is disposed inside of (i.e., within) the combustion chamber 210. The inner wall face 215 of the combustion chamber 210 means an inner wall face of the combustion chamber 210 which defines the combustion chamber 210. The peripheral wall extending portion 57 is comprised of projecting portions 570,571 and 572 formed at three locations in the circumference direction, and a connecting portion 574 connecting between the projecting portions 570-572 in the circumference direction and having an amount of projection smaller than those of the projecting portions 570-572. The ground electrode 30 is joined to a projecting front end 575 of the projecting portion 570.

Next, the ground electrode 30 will be described. The ground electrode 30 is comprised of a metal having an excellent corrosion resistance. As one of the examples, a nickel alloy, such as INCONEL (trade name) 600 or 601, is used. The ground electrode 30 assumes a generally rectangular shape as seen from the cross-section in the longitudinal direction. The base end portion 32 of the ground electrode 30 is welded to the projecting front end 575 of the projecting portion 570 serving as a part of the peripheral wall extending portion 57 of the metal shell 50. The front end portion 31 of the ground electrode 30 extends towards the axis "O" so that the inner face 33 faces the front end portion 22 of the center electrode 20. Further, the spark discharge gap is formed between the inner face 33 and the noble metal tip 90 joined to the front end portion 22 of the center electrode 20.

In the spark plug 100 having such a configuration, the formation position, size and shape of each projecting portion 570-572, which constitutes the peripheral wall extending portion 57 are defined based on a relative positional relation between the spark plug mounted on the engine head 200 and the injection orifice 221 of the injector 220 exposed to the combustion chamber 210. Hereafter, with reference to FIGS. 2 to 4, the formation position, size and shape of each projecting portion 570-572 will be described.

Figure 2:
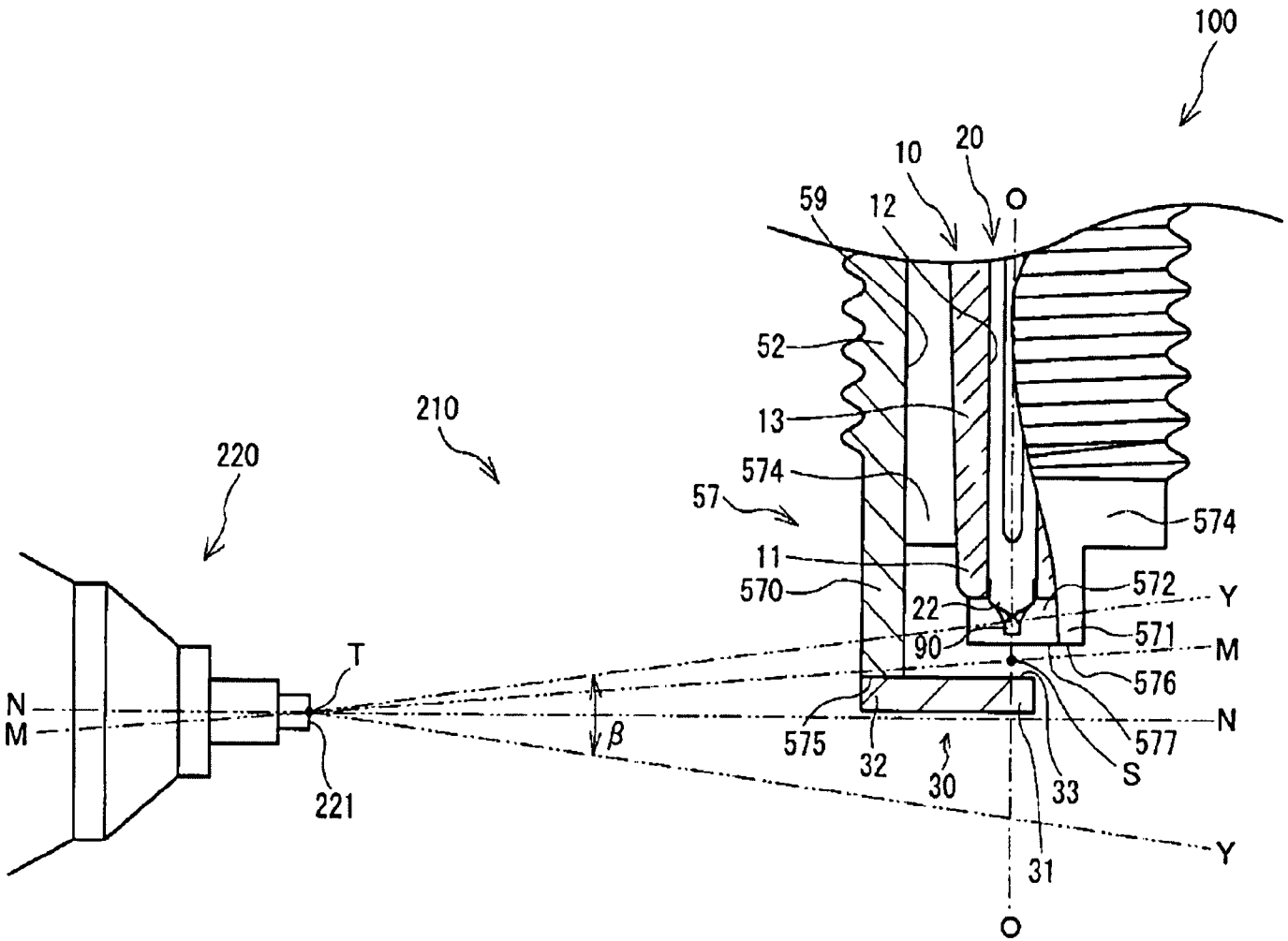
FIG. 2 is a view showing a positional relation between a portion of an injector 220 and a front end portion of the spark plug 100 both of which are projected on a second virtual plane (on a page of FIG. 2) including an opening center T of an injection orifice 221 of an injector 220 and an axis O.

The projecting portions 570-572 are intermittently formed in the circumferential direction of the metal shell 50. The shape of projecting portion 570 has a shape conforming to the original body of the peripheral wall extending portion 57. The shape of the projecting portion 570 is defined by a cylindrical shape extending in the axis "O" direction, that is cut out by two virtual planes that are parallel to a virtual straight line M and the axis O. The virtual straight line M is disposed between the virtual planes. As used herein, the virtual straight line M means a straight line that connects a center "S" of the spark discharge gap to an opening center "T" of the injection orifice 221 of the injector 220. In FIG. 2, the center S is based on a central location between the front end of the noble metal tip 90 and the inner face 33 on the axis O. In FIG. 2, the opening center T is based on a central location of an open end shape (usually circular-shape) of the injection orifice 221. The projecting portion 570 is formed at a location that obstructs the virtual straight line M in the circumferential direction of the metal shell 50. In other words, the projecting portion 570 interrupts a line segment bounded by the opening center T and the center S.

Figure 3:
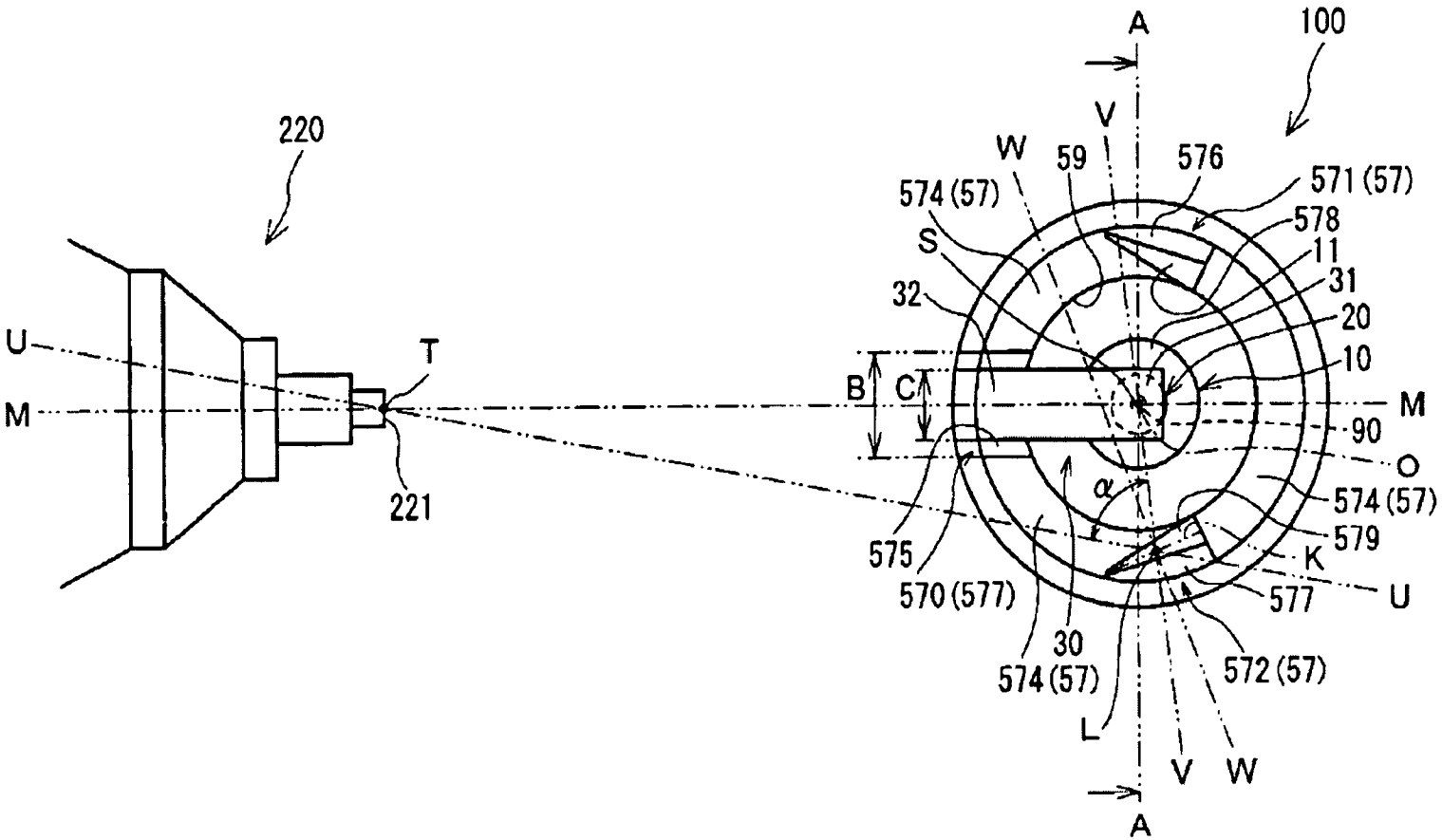
FIG. 3 is a view showing a positional relation between a peripheral wall extending portion 57 seen from a front side in an axis O direction and an injection orifice 221 of the injector 220 both of which are projected on a first virtual plane (on a page of FIG. 3) that intersects perpendicularly with the axis O.

More particularly, as shown in FIG. 2, the projecting portion 570 projects with a sufficient amount of projection (projection length) so that the position of the projecting front end 575 of the projecting portion 570 is located forward with respect to the virtual straight line M in the axis O direction. As shown in FIG. 3, a dimension "B" which ties one end to the other end of the projecting portion 570 in the circumference direction of the cylindrical hole 59 (hereafter referred to as "width direction") is larger than a length "C" which ties one end to the other end of the ground electrode 30 in the width direction. Therefore, when the fuel injected from the injection orifice 221 is spattered towards the spark plug 100, the fuel assuredly strikes against a wall surface of the projecting portion 570 on the outer circumference side, whereby the fuel is unlikely to directly reach the spark discharge gap. On the other hand, the fuel which passes outside of the both ends of projecting portion 570 in the width direction can pass through near the front end portion 11 of the insulator 10, thereby readily conducting the heat from the insulator 10. For this reason, the insulator 10 is unlikely to be heated at a temperature beyond the heat-resistant temperature of the spark plug 100.

Next, as shown in FIG. 3, the projecting portions 571,572 are formed in a symmetrical shape centering on the virtual straight line M, and each inner face 578,579 thereof faces the spark discharge gap. The formation position, size and shape of the projecting portions 571,572 will be described in detail referring to the projecting portion 572 as an example. The projecting portion 572 assumes such a shape that an inner circumference side of the original body of the peripheral wall extending portion 57, which is at first formed into the cylindrical shape in the axis O direction, is cut out by a flat face inclining away from the axis O and extending forward, and further cut out by a flat face including to the axis O. In detail, a projecting front end 577 of the projecting portion 572 has a flat face perpendicular to the axis O, and the inner face 579 facing the axis O has a flat face inclining away from the axis O and extending forward. The inner face 579 reflects the fuel injected from the injection orifice 221 towards the spark discharge gap. Therefore, the direction of the inner face 579 is determined, at least considering the positions of the injection orifice 221 and the spark discharge gap.

In the embodiment, in FIG. 3, a virtual contour line K including a location serving as a center of the inner face 579 in a projecting direction is assumed on the inner face 579 of the projecting portion 572, and a midpoint of the virtual contour line K is represented as "L". Then, a virtual straight line U is assumed to connect the opening center T of the injection orifice 221 and the midpoint L of the virtual contour line K, and a virtual straight line V is assumed to connect the center S of the spark discharge gap and the midpoint L of the virtual contour line K. The direction to which the inner face 579 of the projecting portion 572 faces is defined so that a virtual straight line W which intersects perpendicularly with the virtual contour line K and passes through the midpoint L is in an acute-angle "α" formed by the virtual straight line U and the virtual straight line V on a first virtual plane that intersects perpendicularly with the axis O (on a page in FIG. 3). That is, on the first virtual plane, the direction to which the inner face 579 faces (the direction perpendicular to the virtual contour line K) is in the acute-angle "α" defined by the direction heading to the opening center T of the injection orifice 221 from the midpoint L of the virtual contour line K and the direction heading to the center S of the spark discharge gap from the midpoint L of the virtual contour line K. The projecting portion 572 according to such conditions can direct the fuel, which is injected from the injection orifice 221 and reaches the projecting portion 572 without being intercepted by the projecting portion 570, towards the perimeter of the spark discharge gap when the fuel is reflected at the inner face 579. Further, since the projecting portion 571 is formed into a symmetrical shape to the projecting portion 572 centering on the virtual straight line M, the projecting portion 571 can direct the fuel injected from the injection orifice 221 towards the perimeter of the spark discharge gap when the fuel is reflected at the inner face 578. In addition, when the fuel strikes against the inner faces 578, 579, the fuel which is reflected at the inner faces 578, 579 is mainly vaporized fuel, and the droplet-like incompletely vaporized fuel adheres to the inner faces 578,579. Thus, a fuel bridge is unlikely to be formed in the spark discharge gap.

Moreover, as shown in FIG. 2, the fuel injected from the injection orifice 221 spreads in the combustion chamber 210 with a spread-angle "β". In the embodiment, when an outline of the spread-angle "β" is represented as "Y" on a second virtual plane (on a page in FIG. 2), it is specified that the projecting front ends 576,577 of the projecting portion 571, 572 are located in an area bounded by the outlines Y. That is, the sizes of the projecting portions 571,572 are specified so that at least a certain amount of fuel injected from the injection orifice 221 assuredly strikes against the inner faces 578, 579 of the projecting portions 571,572.

Figure 4:
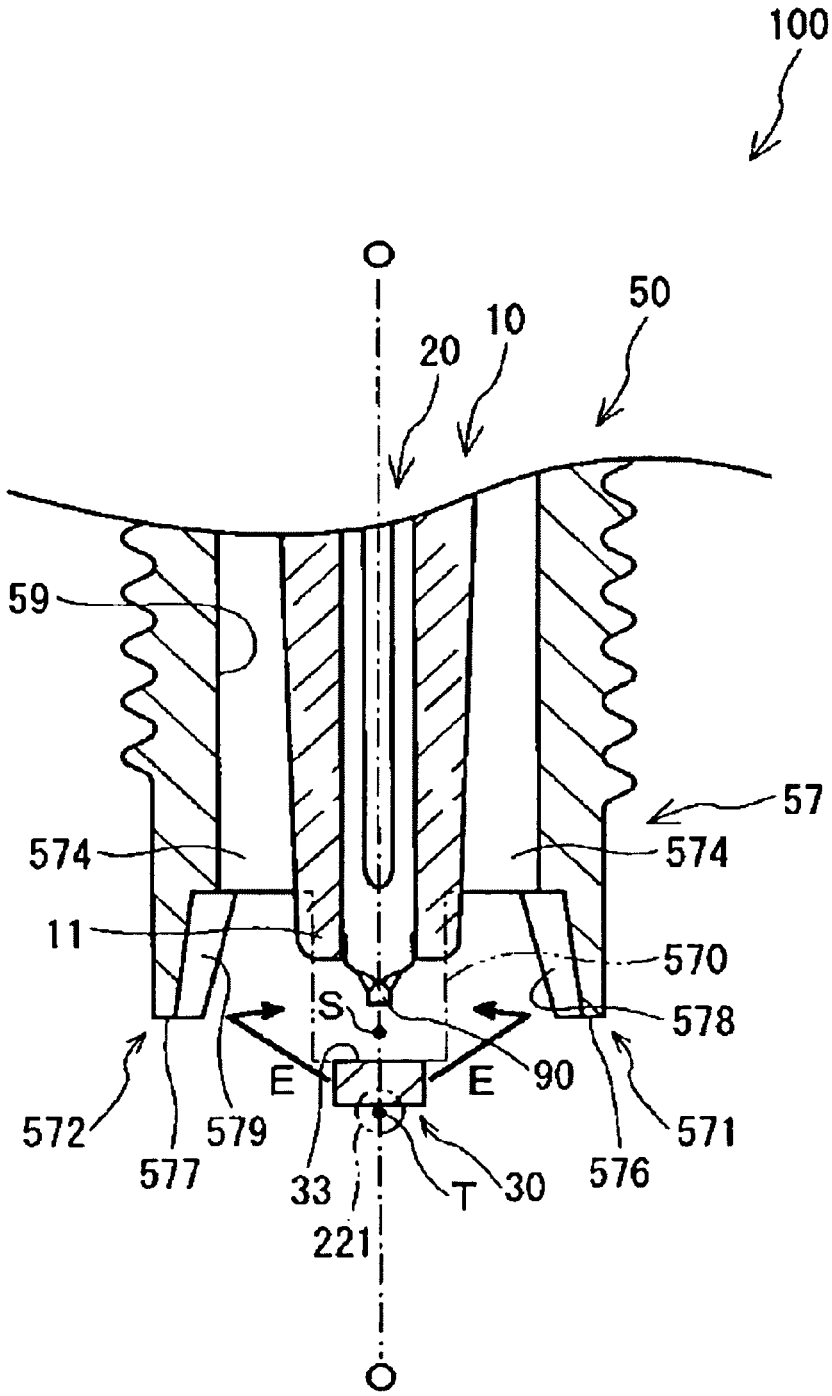
FIG. 4 is an enlarged, sectional view taken along lines A-A of FIG. 3 showing a portion of the spark plug 100 on a front end side.

In FIG. 2, when it is assumed that a virtual straight line N is perpendicular to the axis O and passes through the opening center T of the injection orifice 221, the center S of the spark discharge gap is located rearward with respect to the virtual straight line N in the axis O direction according to the embodiment. In the embodiment specifying such positional relation between the center S of the spark discharge gap and the opening center T of the injection orifice 221, as shown in FIG. 4, the inner face 578,579 of the projecting portion 571, 572 extends forward in the axis O direction and inclines away from the axis O. In this way, when the fuel injected from the injection orifice 221 striking against the inner face 578,579 of the projecting portion 571,572, the reflecting direction can be adjusted to a direction (indicated in arrows E in the drawing) closer to the perimeter of the spark discharge gap compared to the case where the inner face 578,579 does not incline. As described above, mainly the vaporized fuel is reflected at the inner face 578, 579, and flows around the spark discharge gap. Thus, the air-fuel mixture is readily ignited by spark discharge.

Thus, in the spark plug 100 according to the embodiment, the formation position, size and shape of the projecting portions 570-572 which constitutes the peripheral wall extending portion 57 are specified. When the spark plug 100 is mounted on the engine head 200, a mounting direction is defined so that the relative positional relation between the peripheral wall extending portion 57 and the injection orifice 221 of an injector 220 fulfill the above positional relation.

There are various methods to stably mount the spark plug 100 on the engine head 200 with a predetermined angle. One of the examples is that a marking is applied to both the spark plug 100 and the engine head 200, and the spark plug 100 is tightened while matching the respective marking thereof. More particularly, the marking is applied to a predetermined position, such as the opening edge portion 206 of the engine head 200. Then, while mounting the spark plug 100 in the mounting hole 205, the marking is applied to a predetermined position of the spark plug 100 so that the relative positional relation between the peripheral wall extending portion 57 and the injection orifice 221 of the injector 220 is fulfilled. Thereafter, the spark plug 100 may be screwed into the mounting hole 205 and tightened until the respective marking matches. The gasket 5 is crushed and provides a seal when screwing the spark plug 100. Thus, the gasket 5 providing a greater room for deforming to thereby secure the airtightness can compensate the manufacturing tolerance of an individual spark plug.

Further, a formation of male-screw-shaped thread ridge of the fitting portion 52 of the metal shell 50 and a formation of female-screw-shaped mounting hole 205 of the engine head 200 is always conducted under the same conditions in order not to generate the manufacturing tolerance of the metal shell 50 and the engine head 200. That is, the thread ridge of the fitting portion 52 is formed so that a starting position for forming the thread ridge is in a predetermined position of the metal shell 50. Similarly, the mounting hole 205 is formed in a predetermined position of the engine head 200 so that the starting position for forming the thread ridge of the fitting portion 52 is in contact with the mounting hole 205 when fixing the spark plug 100. In this way, a relative direction (angle phase) of both engine head 200 and the spark plug 100 after tightening the spark plug 100 to the engine head 200 is settled. Further, the relative positional relation between the peripheral wall extending portion 57 and the injection orifice 221 of the injector 220 can be always constant. Alternatively, the present invention may be applied to a spark plug that does not require a screw thread for fixing. In addition, the above-described mounting method is one of the examples, and the invention is not limited to the above-described embodiments. It is possible to employ conventionally known various methods.

Notably, various modification of the embodiment described above will occur. For example, in the above-described embodiment, the peripheral wall extending portion 57 is formed in such a manner that the front end side of the cylindrical hole 59 of the metal shell 50 projects towards the front end side. In this case, the original body of the peripheral wall extending portion 57, which is at first formed into a cylindrical shape in the axis O direction, is preferably cut out so as to form the projecting portions 570-572 and the connecting portion 574. Further, the peripheral wall extending portion 57 may be formed by another method other than the cutting. For example, the original body of the cylindrical peripheral wall extending portion 57 which is aligned with the projecting front end of the connecting portion 574 is formed in advance along the metal shell 50 in the axis O direction. Then, metal pieces shaped like the projecting portion 570-572 may be welded, respectively. In this case, the ground electrode 30 and the projecting portion 570 may be integrally formed, and a portion serving as the ground electrode may be inwardly bent after the welding so as to form a spark discharge gap. Alternatively, a crown-shaped peripheral wall extending portion 57 having the projecting portions 570-572 and the connecting portion 574 therein may be separately formed and welded to the front end of the metal shell 50.

Figure 5:
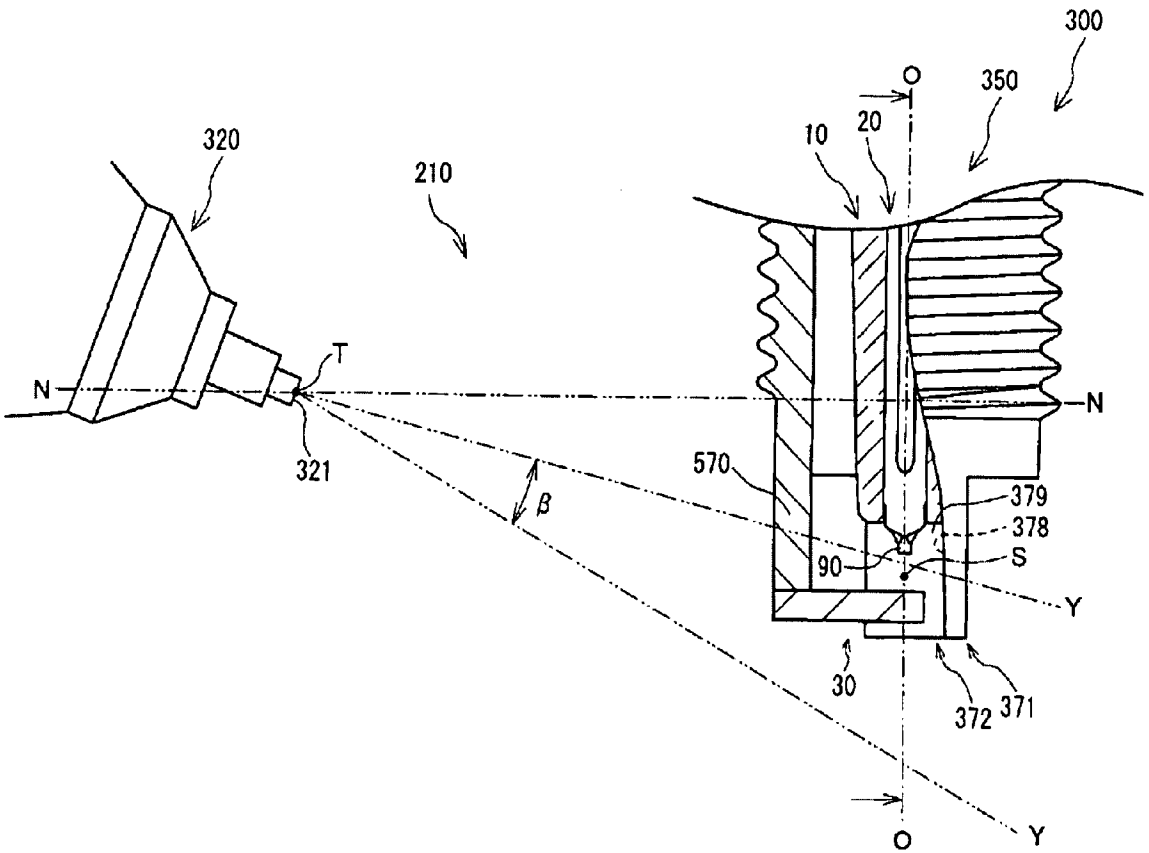
FIG. 5 is a view showing a positional relation between the portion of the injector 220 and the portion of the spark plug 100 on the front end side when a center S of the spark discharge gap is located forward in the axis O direction with respect to a virtual straight line N that intersects perpendicularly with the axis O and passes through an opening center T of the injection orifice 221 of the injector 220.
Figure 6:
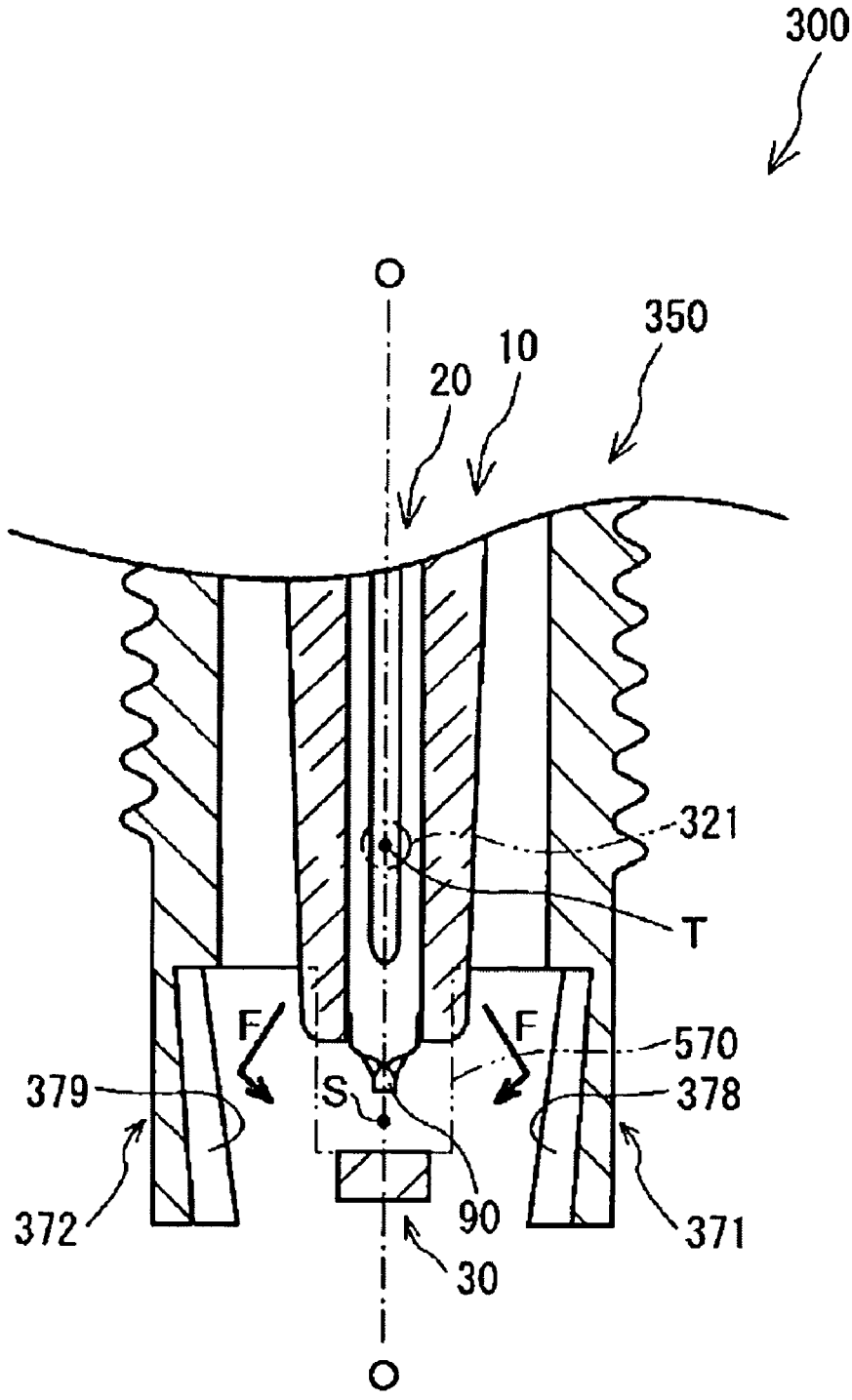
FIG. 6 is a sectional view of the portion of the spark plug 100 on the front end side which is sectioned with a flat surface that passes through the axis O as seen in an arrow direction in FIG. 5.

On the other hand, as shown in FIG. 5, the present invention is applicable to a spark plug 300 mounted on an engine. The spark plug 300 has a structure where the center S of the spark discharge gap is located forward with respect to the virtual straight line N which passes through the opening center T of an orifice 321 of an injector 320 and intersects perpendicularly to the axis O. In this case, as shown in FIG. 6, inner faces 378,379 of projecting portions 371,372 of a metal shell 350 are preferably formed into faces inclining to the axis O and extending forward in the axis O direction. In this way, similar to the above-described embodiment, the reflected fuel injected from the injection orifice 321 and striking against the inner face 378,379 of the projecting portion 371,372 can further reach to the perimeter of the spark discharge gap (arrow F in the drawing) compared to the case where the inner faces 378,379 does not incline. That is, in the axis O direction, the reflecting direction of the fuel can be adjusted so that the vaporized fuel securely flows around the spark discharge gap. As a result, the air-fuel mixture can be readily ignited by the spark discharge.

Figure 7:
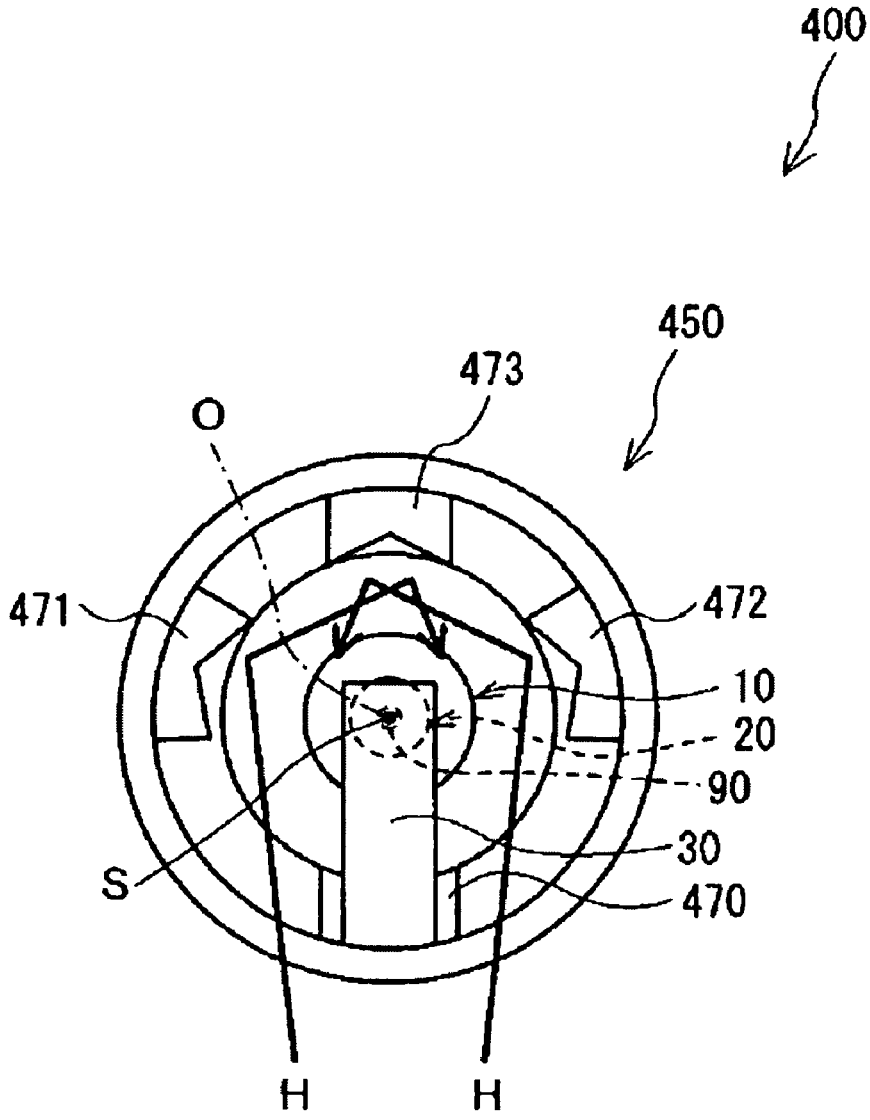
FIG. 7 is a view showing a configuration of a peripheral wall extending portion 450 of a spark plug 400 according to a modification.

Furthermore, the number of projecting portions 570-572 of the peripheral wall extending portion 57 is not necessarily three, but it is preferably two or more. For example, as a spark plug 400 shown in FIG. 7, the metal shell 450 may have projecting portions 470-473. The ground electrode 30 is joined to the projecting portion 470 that intercepts the fuel injected from the injection orifice of the injector (refer to FIG. 1) directly heading to the spark discharge gap. Fuel that reaches the projecting portions 471-473 without striking against the projecting portion 470 is reflected at the projecting portions 471, 472, 473 and is directed toward the spark discharge gap. In this modification, the injected fuel is separated into a vaporized fuel and a droplet-like incompletely vaporized fuel at the projecting portions 471,472. The projecting portions 471, 472 are disposed so that the reflected vaporized fuel is directed toward the projecting portion 473. Then, the reflected vaporized fuel is reflected at the projecting portion 473 towards the spark discharge gap (Arrow H shows a path where the fuel flows). In the spark plug 400 with such structure, the vaporized fuel which strikes against the projecting portion 471,472 is reflected towards the projecting portion 473 with a slowed down flow velocity. When the vaporized fuel strikes against the projecting portion 473 and is reflected towards the spark discharge gap, the flow velocity of the fuel further slows down. Therefore, the vaporized fuel tends to stagnate in the spark discharge gap, whereby the air-fuel mixture can be readily ignited by the spark discharge.

Moreover, although the above-mentioned embodiment has described that the inner faces 578,579 of the projecting portions 571,572 are flat faces, they are not limited to such faces. For example, the peripheral wall extending portion 57 can have an inwardly curved inner face without cutting an inner circumferential face of the cylindrical original wall extending portion. Alternatively, the inner face 578,579 may assume a multi-step form so that the greater amount of vaporized fuel is reflected toward the center of spark discharge gap, or may assume a concave form so that the vaporized fuel is not only reflected in a direction perpendicular to the axis O but also reflected in the axis O direction. Further, in the above-mentioned embodiment, although the ground electrode 30 is joined to the projecting portion 570, the ground electrode 30 may be joined to the projecting portion 571 or the projecting portion 572 as long as the projecting portion 570 intercepts the injected fuel heading directly to the spark discharge gap. The number of ground electrode 30 is not necessarily one, and it may be formed on the projecting portion 571 and the projecting portion 572, respectively. In this case, the fuel injected from the injection orifice of the injector (refer to FIG. 1) tends to directly reach and adhere to rearward faces of the ground electrodes joined to the projecting portion 571 and the projecting portion 572. Since the fuel adhering to the rearward faces of the ground electrodes tends to cause a fuel bridge, as in the above-mentioned embodiment, the projecting portion joined to a ground electrode preferably has a structure which intercepts the fuel injected from the injection orifice of the injector directly heading to the spark discharge gap.

Moreover, in the above-mentioned embodiment, the spark plug 100 having the peripheral wall extending portion 57 that projects towards the combustion chamber 210 side with respect to the inner wall face 215 of the combustion chamber 210 has been described in the above. However, the peripheral wall extending portion 57 does not necessarily project towards the combustion chamber 210 side with respect to the inner wall face 215 of the combustion chamber 210. For example, a projecting front end of the connecting portion 574 constituting the peripheral wall extending portion 57 is not necessarily located in a position which projects beyond the inner wall face 215 of the combustion chamber 210. That is, the projecting front end of connecting portion 574 may be in a position aligned with the inner wall face 215, or may be in a rearward position (i.e., recessed) in the mounting hole 205 with respect to the inner wall face 215. As the length of the connecting portion 574 is made shorter, the fuel that passes through the front end portion 11 of the insulator 10 increases, thereby easily conducting the heat away from the insulator 10. However, rigidity of the projecting portion 570 is likely to deteriorate. Thus, it is preferable to shorten the length of connecting portion 574 while maintaining the sufficient rigidity thereof.

Moreover, in the above-mentioned embodiment, although the direction to which the inner face 579 of the projecting portion 572 faces is specified based on the midpoint L of the virtual contour line K, it is not limited to such a direction. The reason for specifying the direction to which the inner face 579 of the projecting portion 572 faces using the perpendicular line, which passes through the center of the inner face 579 of the projecting portion 572, will be described below. In this respect, when the inner face 579 of the projecting portion 572 is formed into a shape which enables the vaporized fuel reflected at the center of the inner face 579 of the projecting portion 572 to be directed toward the center of the spark discharge gap, it is expected that the amount of the vaporized fuel, that is reflected at the inner face 579 of the projecting portion 572 and is directed near the center of the spark discharge gap, will increase. Therefore, by way of example, the center of gravity of the inner face 579 may be used as the center of the inner face 579 of the projecting portion 572. Alternatively, when the inner face 579 is formed into a rectangular shape, the intersection of diagonal lines thereof may be used as the center. Furthermore, the size, shape and location of the inner face 579 of the projecting portion 572 may be defined so that the vaporized fuel reflected at a location other than the center of the inner face 579 of the projecting portion 572 is directed to the center of the spark discharge gap. In such a case, the vaporized fuel can be directed to the center of the spark discharge gap. The inner faces of the projecting portions 571,572 may be formed into a shape which enables the vaporized fuel reflected at the inner faces 578,579 to be directed to the center of the spark discharge gap. The inner faces 578,579 do not necessarily incline to the axis O direction.

The invention claimed is:

1. A spark plug comprising:

a center electrode;

an insulator having an axial bore that extends in an axis direction and holding the center electrode at a front end side of the axial bore;

a metal shell having a cylindrical hole that extends in the axis direction and accommodates the insulator therein, wherein the metal shell includes a peripheral wall extending portion at a front end side thereof which is formed so as to radially surround a perimeter of the front end portion of the insulator when the metal shell is mounted on an engine head of a combustion engine, and wherein the peripheral wall extending portion has a projecting portion that extends in the axis direction along with the front end of the insulator towards the combustion chamber side with respect to the inner wall surface of the combustion chamber; and a ground electrode having one end joined to the peripheral wall extending portion and the other end forming a spark discharge gap with a front end side of the center electrode, and wherein the peripheral wall extending portion is comprised of a plurality of projecting portions intermittently formed in the metal shell in a circumference direction thereof and extending in the axis direction towards the combustion chamber side with respect to the inner wall surface, and a connecting portion connecting between the plurality of projecting portions of the metal shell in the circumference direction and positioned so that a front end of the connecting portion is disposed relatively rearward with respect to the projecting portions, wherein a center of a line segment bounded by a center of a front end portion of the center electrode and an intersection, which is formed by a straight line passing through the center of the center electrode and parallel to an axis of the center electrode and the ground electrode, is regarded as a center of the spark discharge gap, wherein a direction of the spark plug is adjusted when the spark plug is mounted on the engine head, wherein, in the projecting portions of the peripheral wall extending portion, a first projecting portion where the one end of the ground electrode is joined to a projecting front end thereof is located in a position where a first virtual straight line connecting an opening center of the injection orifice and the center of the spark discharge gap is interrupted when the injection orifice of the fuel, the peripheral wall extending portion and the spark discharge gap, those of which are exposed to the combustion chamber, are projected on a first virtual plane perpendicular to the axis direction, and wherein, when a direction that connects both ends of the first projecting portion in a peripheral direction of the metal shell is regarded as a width direction, a length of the first projecting portion in the width direction is longer than a length between ends of the ground electrode in the width direction.

2. A spark plug according to claim 1, wherein, in a state where the spark plug is mounted on the engine head, the projecting front end of the first projecting portion is located so as to project to the combustion chamber in the axis direction with respect to the first virtual straight line when the injection orifice, the first projecting portion and the spark discharge gap are projected on a second virtual plane including the opening center of the injection orifice and the axis of the metal shell.

3. A spark plug according to claim 2, wherein a projecting front end of a second projecting portion is disposed in a region bounded by an outline of a spread angle of the fuel injected from the injection orifice when the second projecting portion, which is different from the first projecting portion in the projecting portions of the peripheral wall extending portion, and the outline of the spread angle of the fuel injected from the injection orifice are projected on the second virtual plane of the spark plug.

4. A spark plug according to claim 3, wherein, on the first virtual plane, at a center of an inner face facing to the spark discharge gap in an outer surface of the second projecting portion, a direction which intersects perpendicularly with the inner face is within an acute-angle defined by a direction from the center of the inner surface to the opening center of the injection orifice and a direction from the center of the inner surface to the center of the spark discharge gap.

5. A spark plug according to claim 4, wherein, on the second virtual plane, the inner face of the second projecting portion is formed into a face inclining to the axis as it extends inside of the combustion chamber along the axis direction when the center of the spark discharge gap is located on the combustion chamber side in the axis direction with respect to a second virtual straight line that intersects perpendicularly with the axis through the opening center of the injection orifice.

6. A spark plug according to claim 4, wherein, on the second virtual plane of the spark plug, the inner face of the second projecting portion is formed into a face inclining away from the axis as it extends inside of the combustion chamber along the axis direction when the center of the spark discharge gap is disposed in a position opposed to the combustion chamber in the axis direction with respect to the second virtual straight line that intersects perpendicularly with the axis through the opening center of the injection orifice.

7. A spark plug for use in an internal combustion engine having a fuel injection orifice within a combustion chamber, said spark plug comprising:

a center electrode;

an insulator having an axial bore that extends in an axis direction, said axial bore holding the center electrode at a front end side of the axial bore;

a metal shell having a cylindrical hole that extends in the axis direction, said cylindrical hole accommodating the insulator therein, said metal shell having a fitting portion for mounting the spark plug to an engine head of a combustion engine, said fitting portion dimensioned to position a front end side of said spark plug in a predetermined orientation relative to a fuel injection orifice in a combustion chamber when said spark plug is attached to said combustion engine;

a peripheral wall extending portion forms part of the metal shell and extends from a front end side of said metal shell, said peripheral wall extending portion comprised of a plurality of spaced-apart projecting portions, including a first projecting portion having a predetermined width, said projecting portions being intermittently formed in the metal shell in a circumferential direction and extending in an axis direction; and a ground electrode having one end joined to said first projecting portion and a free end forming a spark discharge gap with a front end side of the center electrode, a center of the spark discharge gap is defined midway between the front end side of the center electrode and a surface of said ground electrode along a straight line passing through the center of the center electrode along the axis of the center electrode, said ground electrode having a width that is less than the predetermined width of said first projecting portion, said first projecting portion being disposed between the center of the electrode gap and the center of the injection orifice when said spark plug is mounted in said predetermined orientation in said combustion chamber of said combustion engine.

* * * * *